US007945193B2

(12) United States Patent
Kakitani

(10) Patent No.: US 7,945,193 B2
(45) Date of Patent: May 17, 2011

(54) IMAGE FORMING APPARATUS AND DEVELOPING APPARATUS

(75) Inventor: Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/612,269

(22) Filed: Nov. 4, 2009

(65) Prior Publication Data

US 2010/0111569 A1 May 6, 2010

(30) Foreign Application Priority Data

Nov. 5, 2008 (JP) ..... 2008-284222

(51) Int. Cl.
*G03G 15/06* (2006.01)
*G03G 15/00* (2006.01)

(52) U.S. Cl. ..... 399/222; 399/111; 399/167

(58) Field of Classification Search ..... 399/111, 399/119, 167, 222
See application file for complete search history.

(56) References Cited

U.S. PATENT DOCUMENTS

| | | | | |
|---|---|---|---|---|
| 6,424,811 | B1 * | 7/2002 | Tsuda et al. | 399/167 |
| 6,823,155 | B2 * | 11/2004 | Tsuda et al. | 399/111 |
| 7,212,768 | B2 | 5/2007 | Numagami et al. | |
| 7,224,926 | B2 | 5/2007 | Toba et al. | |

FOREIGN PATENT DOCUMENTS

| | | | |
|---|---|---|---|
| JP | 10-232526 | A | 9/1998 |
| JP | 2002-196556 | | 7/2002 |
| JP | 2005-292511 | A | 10/2005 |
| JP | 2006-106418 | A | 4/2006 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member; a developing device including a developer carrying member for supplying the developer to the image bearing member, a developer feeding member, provided rotatably in a developing container, first and second driving force receiving members, provided at opposite end portions of the developer carrying member, for driving the developer carrying member and the developer feeding member, respectively; a first and second drive inputting members, for inputting drive to the first and second driving force receiving members, respectively. Directions, toward and away from the image bearing member, of forces are applied to abutment members, which determine a gap between the image bearing member and the developer carrying member, at the time when the drives are inputted to the first driving force receiving member and the second driving force receiving member, respectively.

2 Claims, 4 Drawing Sheets

IMAGE FORMING APPARATUS AND DEVELOPING APPARATUS

FIELD OF THE INVENTION AND RELATED ART

The present invention relates to an image forming apparatus such as a copying machine, a laser beam printer which visualizes an electrostatic latent image on a latent image carrying member by a developing device.

For example, in an electrophotographic image forming apparatus, a peripheral surface of a rotatable electrophotographic photosensitive drum as an image bearing member is uniformly charged by a charging device, the image exposure is carried out by image exposure device means on the charged surface by which the electrostatic latent image is formed. The developer is supplied by the developing device to the electrophotographic photosensitive drum on which the electrostatic latent image is formed to develop the electrostatic latent image into a developer image (toner image). The toner image is transferred onto the recording material by a transferring device. The toner image on the recording material is fixed into a fixed image by a fixing device, and it outputted as a print (a copy and print). From the electrophotographic photosensitive drum after the toner image transferring, the untransferred toner which remains on the surface is removed by a cleaning device to be prepared for the repetition image formation.

In an example of the structure of the developing device in such an image forming apparatus, there are provided a developer carrying member for carrying a developer and supplying the developer to the image bearing member and a developer feeding member. As an example of a drive transmission to the each member in the developing device, one drive input line of the image forming apparatus from a main assembly is branched to drive the developer carrying member and the developer feeding member, respectively (Japanese Laid-open Patent Application 2005-292511).

In the image forming apparatus with the above described structure, a spacer is provided on each side of a developer carrying member and contacts the image bearing member in order to maintain a uniform gap between the image bearing member and the developer carrying member. The spacer may also be provided at each side of a frame which holds the image bearing member and contacted to the developer carrying member. This is because, when there is a gap between the image bearing member and the developer carrying member varies, there is a liability that an amount of supply of the developer to the image bearing member may be unstable, and the formed image may involve a defect such as density unevenness. As means for the contact, the developing device and the frame which holds the image bearing member are swingable about a fulcrum, and they are contacted to each other by pressing means such as a spring. In an example, for a rotational driving of the developer carrying member, the drive is transmitted by a gear and on from an end of the developing device (JP 2006-106418, a).

In Japanese Laid-open Patent Application 2006-106418, in the case where the drive is inputted from the one-end portion, since a driving input position to the developing device is different from the position of a center of swinging of the developing device, a moment is produced in the developing device by the driving force transmission through the gear. By this moment, a small torsion is produced in the developing device, and the pressures to the spacers for the developer carrying member provided in the developing device become uneven in the longitudinal direction. As a result, there is the liability that an image density non-uniformity or color omission due to the poor pressing and so on may occur.

As a countermeasure against such image defects, in an example, when inputting the drive to the both sides of the developer carrying member, the developer carrying member and the image bearing member are kept parallel with each other by inputting the drive after the drive is branched to the respective sides of the developer carrying member, (JP 10-232526).

However, when the structure of Japanese Laid-open Patent Application Hei 10-232526 is incorporated in the structure of Japanese Laid-open Patent Application 2005-292511, a parts count becomes high.

For example, it would be considered that the two driving input lines to the developing device are provided, and the drive is inputted to the developer carrying member and the developer feeding member, respectively to change the rotational speeds of the developer carrying member and the developer feeding member independently from each other. In such a case, when the structure of Japanese Laid-open Patent Application Hei 10-232526 is applied, the driving mechanism (drive transmitting portion) for the branching is required for the each of the driving input of the developer carrying member and the driving input of the developer feeding member. For this reason, the drive transmitting portions are required for the respective sides of the developer carrying member, and the structure is complicated.

SUMMARY OF THE INVENTION

In view of this, the principal object of the present invention is to provide an apparatus wherein.

In driving an inside member of a developing device from outside, the difference between the pressures to the spacers of the developer carrying members is suppressed without branching the drive inputting portion to opposite ends.

According to an aspect of the present invention there is provided an image forming apparatus comprising an image bearing member for carrying a latent image; a developing device including a rotatable developer carrying member for carrying a developer and for supplying the developer to said image bearing member, a developer feeding member, provided rotatably in a developing container containing the developer, for feeding the developer, a first driving force receiving member, provided at one end portion of said developer carrying member with respect to a rotational axis direction of said developer carrying member, for receiving a driving force for driving said developer carrying member, a second driving force receiving member, provided at the other end portion of said developer carrying member with respect to the rotational axis direction of said developer carrying member, for receiving a driving force for driving said developer feeding member, abutment members provided at respective end portions of said developer carrying member to determine a gap between said image bearing member and said developer carrying member by being abutted to respective end portions of said image bearing member; a supporting mechanism for supporting said developing device rotatably relative to a main assembly of said apparatus; a first drive inputting member, provided in said main assembly side of the apparatus, for directly inputting drive to said first driving force receiving member; and a second drive inputting member, provided in said main assembly side of the apparatus, for directly inputting drive to said second driving force receiving member; wherein said first driving force receiving member and said second driving force receiving member are provided such that directions of components, in directions toward and away from said image bearing member, of forces applied to said abutment members at the time when the drives are inputted to said first driving force receiving member and said second driving force receiving member, respectively.

DESCRIPTION OF THE PREFERRED EMBODIMENT

The preferred embodiments of the present invention will be described in conjunction with the accompanying drawings. The dimensions, the materials, the configurations, the relative positions, and the constituent parts which will be described hereinafter may be properly changed by one skilled in the art depending on the structures and the various conditions of a device to which this invention is applied, and the scope of this invention is not limited to specific dimensions, materials, configurations, relative positions and on of the embodiments which will be described below.

(General Arrangement of Image Forming Apparatus)

Figure 7:
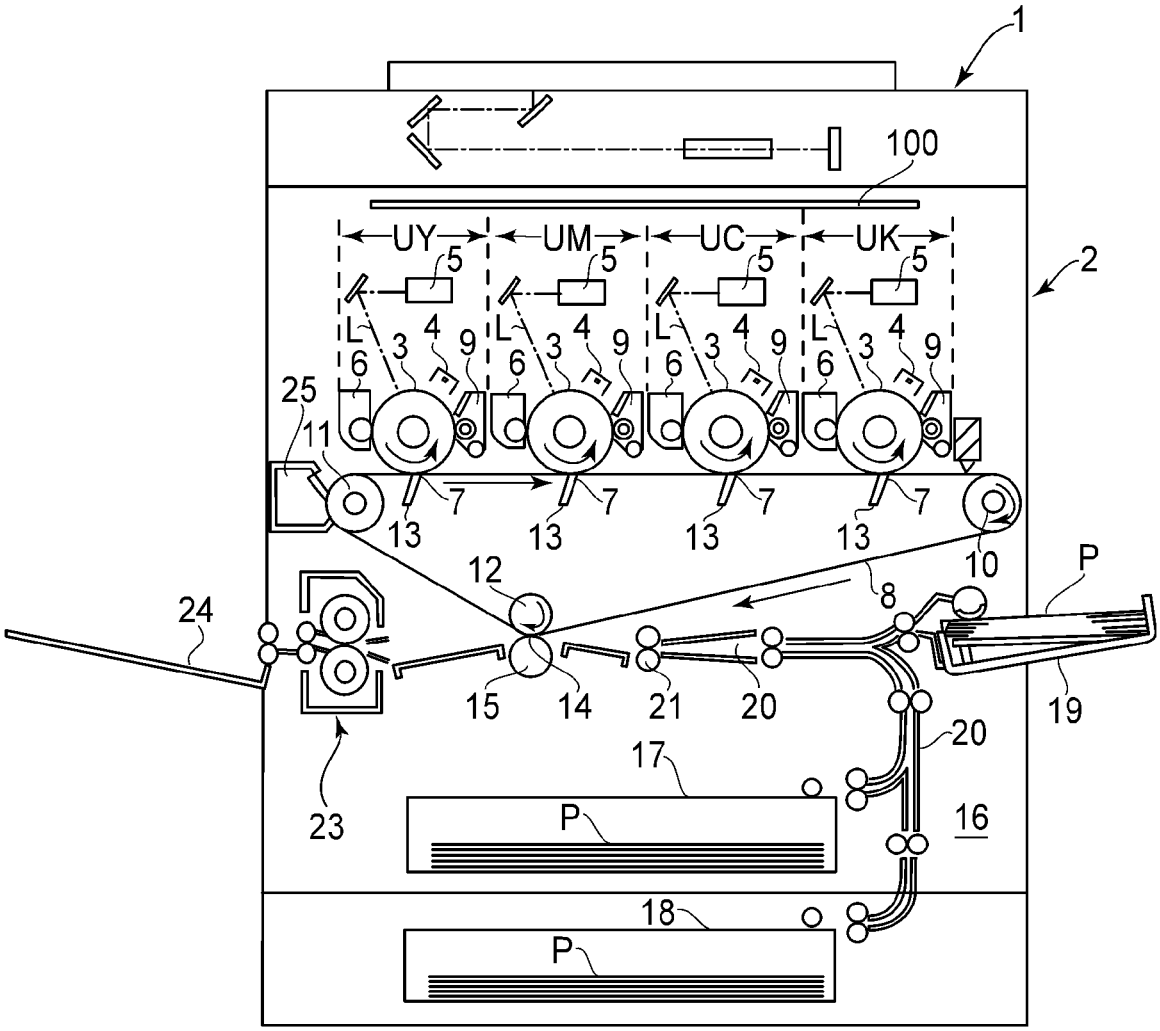
FIG. 7 is a schematic sectional view of an example of an image forming apparatus.

FIG. 7 is a schematic sectional view of an image forming apparatus according to the present embodiment. This image forming apparatus is an electrophotographic full-color copying machine of a tandem type and an intermediate transfer type, and is provided with the four color image forming stations UY, UM, UC, UK.

Designated by 1 is an image reading station (digital color image reader) and it scans the image of a color image original placed on the original supporting platen glass by a movable optical system to read it photoelectrically as the color separation signal (electric signal) by a full-color sensor (CCD). A color separation signal is subjected to a predetermined image process in an image processing station, and thereafter, is fed to a control unit 100 of an image outputting station (digital color image printer) 2.

In the image outputting station 2, designated by UY, UM, UC, UK are the first-fourth color image forming stations and are disposed in tandem in the image outputting station 2. Each color image forming station is an electrophotographic processing mechanism of a laser exposure type and has the same structures. More particularly, in each color image forming station UY, UM, UC, UK, designated by 3 includes a drum like electrophotographic photosensitive member (drum) as a rotatable image bearing member for carrying a latent image, which is rotated in the counterclockwise direction of the arrow. Designated by 4 is a primary charging device for charging an outer surface of a drum 3 uniformly, and 5 is a laser exposure device as an image exposure device for forming an electrostatic latent image corresponding to the color separation signal by exposing the uniform charged surface of the drum 3 scanningly to a laser beam L. Designated by 6 is a developing device for visualizing the electrostatic latent image of a drum surface into a toner image.

In the image forming apparatus of this example, the developing device 6 of a first color image forming station UY contains yellow toner as the developer. The developing device 6 of a second color image forming station UM contains magenta toner. The developing device 6 of a tertiary color image forming station UC contains cyan toner. The developing device 6 of a fourth color image forming station UK contains black toner.

On the basis of the color separation signal fed to the control unit 100 of the image outputting station 2 from the image processing station of the image reading station 1, the first color image forming station UY is controlled so that a yellow toner image is formed at the predetermined control timing on the surface of the drum 3. The second color image forming station UM is controlled so that a magenta toner image is formed at the predetermined control timing on the surface of the drum 3. The tertiary color image forming station UC is controlled so that a cyan toner image is formed at the predetermined control timing on the surface of the drum 3. The fourth color image forming station UK is controlled so that a black toner image is formed at the predetermined control timing on the surface of the drum 3.

The toner image formed on each of the surfaces of the drums of the color image forming stations UY, UM, UC, UK is sequentially superimposedly transferred onto a surface of an endless flexible intermediary transfer belt (belt) 8 rotationally driven in a primary transfer portion 7. By this, a full-color toner image by the superposition of the four toner images is combined on the surface of a belt 8. In each of the color image forming stations UY, UM, UC, UK, the toner which remains on the drum 3 without transferring onto the belt 8 is removed by a cleaning device 9.

The belt 8 is stretched around a secondary transfer opposing roller 12 with a driving roller 10 and a follower roller 11 as a tension roller, and is rotationally driven in the clockwise direction of the arrow substantially the same speed as a rotational speed of the drum 3. A belt portion between the driving roller 10 and the follower roller 11 is opposed to or contacted to a lower surface of the drum 3 of the each of the color image forming stations UY, UM, UC, UK to form the primary transfer portion 7. Designated by 13 is a primary transfer charger disposed at a back side of the belt 8 in the position of each of the primary transfer portions 7, and a predetermined voltage is supplied at the time of the primary transfer operation.

The full-color toner image formed on the surface of the belt 8 is fed into a secondary transfer portion 14 by the continuing rotation of the belt 8. In the secondary transfer portion 14, a secondary transfer roller 15 is press-contacted through the belt 8 toward the secondary transfer opposing roller 12. A nip between the secondary transfer roller 15 and the belt 8 is the secondary transfer portion 14. A sheet-like recording material (transfer material) P is fed from the sheet feeding unit (16) side at the predetermined control timing to the secondary transfer portion 14, by which the full-color toner image is sequentially transferred (secondary transfer) from a belt 8 surface to the surface of recording material P. The predetermined voltage is applied to the secondary transfer roller 15 at the time of the secondary transfer of the toner image.

A sheet feeding unit 16 is provided with the two or more of sheet feeding cassettes 17, 18 and a manual feed tray 19, and one-sheet recording material P is fed at the predetermined control timing from the sheet feeding cassette of a stage selected on the basis of a recording material size and so on or the manual feed tray. The fed recording material P is fed to the registration roller 21 along a sheet passage 20. At this time, a registration roller 21 is at rest, and therefore, a free end of recording material P abuts to the nip. Thereafter, the rotational driving of the registration roller 21 is started at the timing of the start of the image formation in the each of the color image forming stations UY, UM, UC, UK. The timing of the rotation start of the registration roller 21 is set such that the recording material P and the toner images transferred (primary transfer) onto the belt 8 from the color image forming stations UY, UM, UC, UK align with each other in the secondary transfer portion 14.

The recording material P which has received the toner image from the belt 8 through the secondary transfer portion 14 is separated from the belt surface and is accurately guided to a fixing nip of the fixing device (fixing unit) 23 by a feeding guide 22. The recording material P is nipped and fed by the fixing nip and the toner image is fixed on the surface of recording material P by the heat and the pressure in the feeding process. The recording material P which is discharged out of the fixing device 23 is stacked on a sheet discharge tray 24.

Designated by 25 is a cleaning unit for carrying out the cleaning of an image formation surface of the belt 8. In the secondary transfer portion 14, the toner which remains on the belt 8 without transferring onto recording material P is removed by the cleaning unit 25.

(Developing Device)

The structure of the developing device 6 will be described. Here, relating to the developing device or the members which constitute it, a longitudinal direction is a direction of a rotation axis of a developing sleeve which is the rotatable developer carrying member of the developing device. A front side of the developing device is a surface opposed to the drum. A rear surface is the surface of the opposite side as seen from the front side. Left and right is the left (front side) or right (rear side) as seen from the front side.

Figure 1:
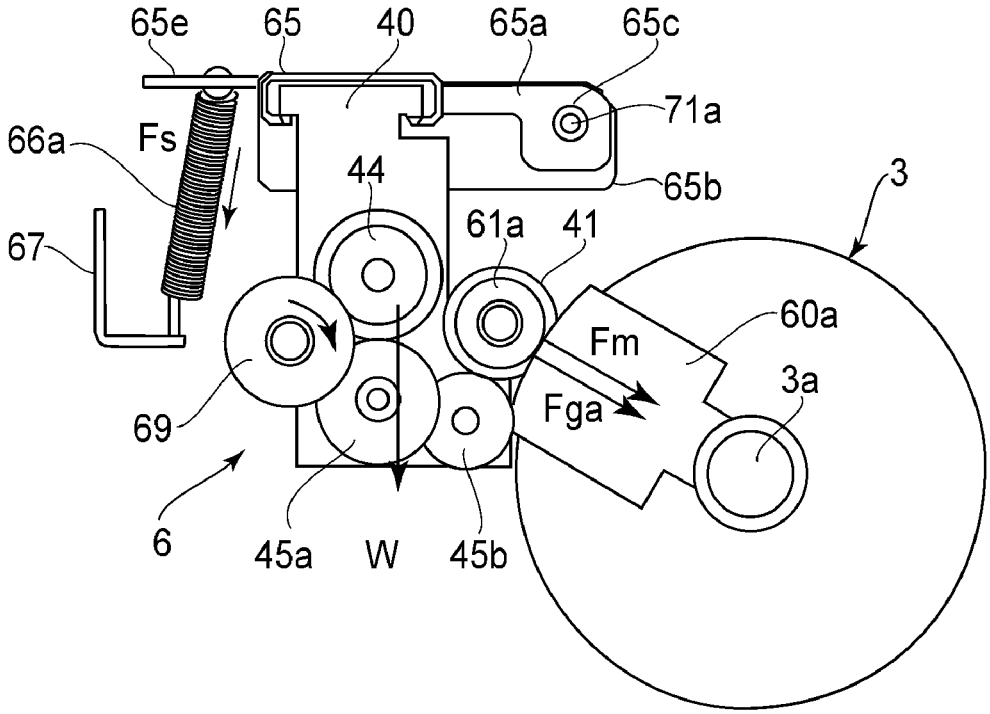
FIG. 1 is a right side view of a developing device and a drum.
Figure 2:
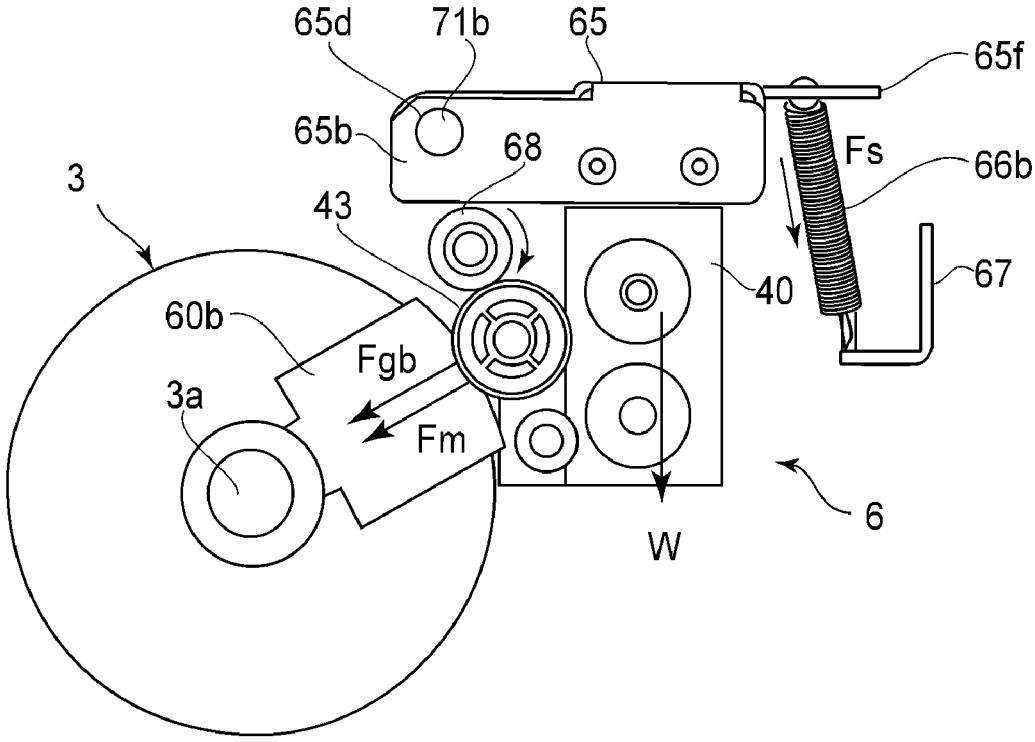
FIG. 2 is a left side view of the developing device and the drum.
Figure 3:
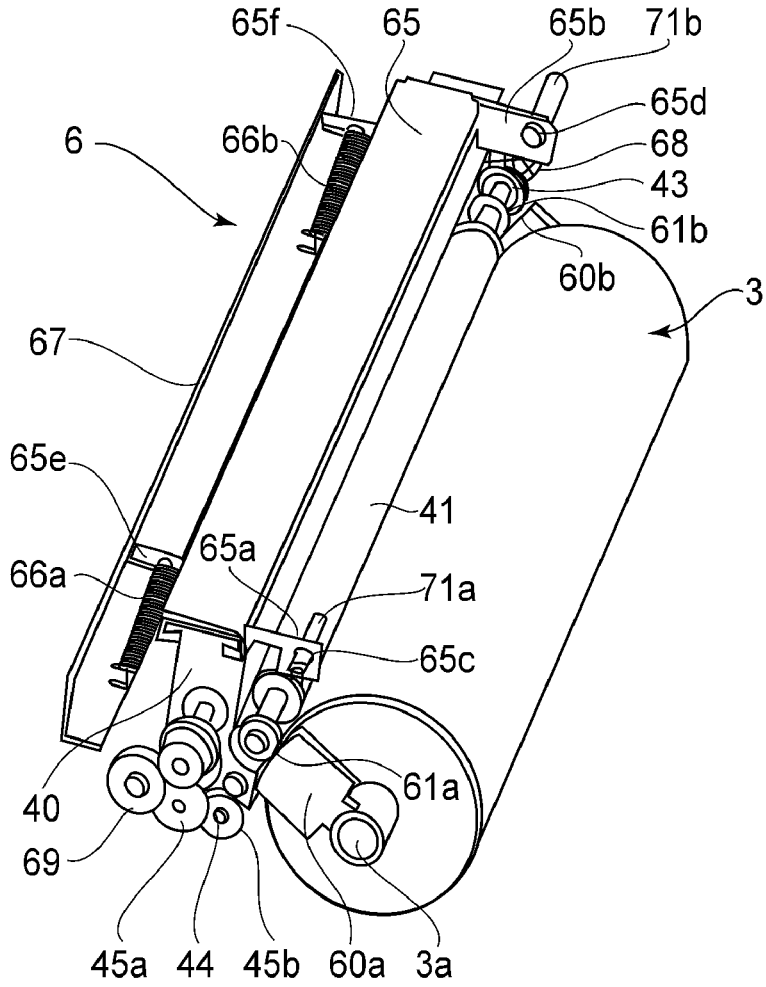
FIG. 3 is a perspective view of the developing device and the drum.
Figure 4:
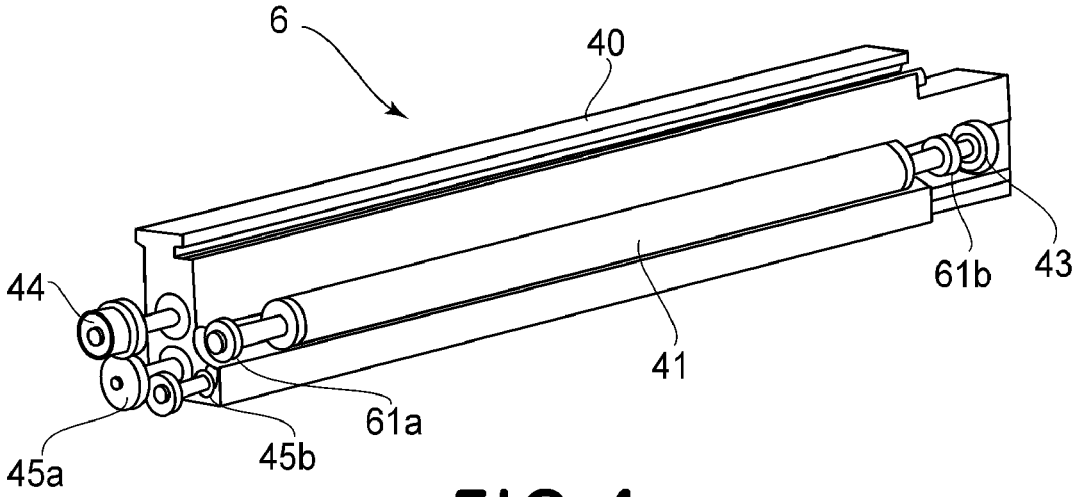
FIG. 4 is a perspective view of a front side of the developing device.
Figure 5:
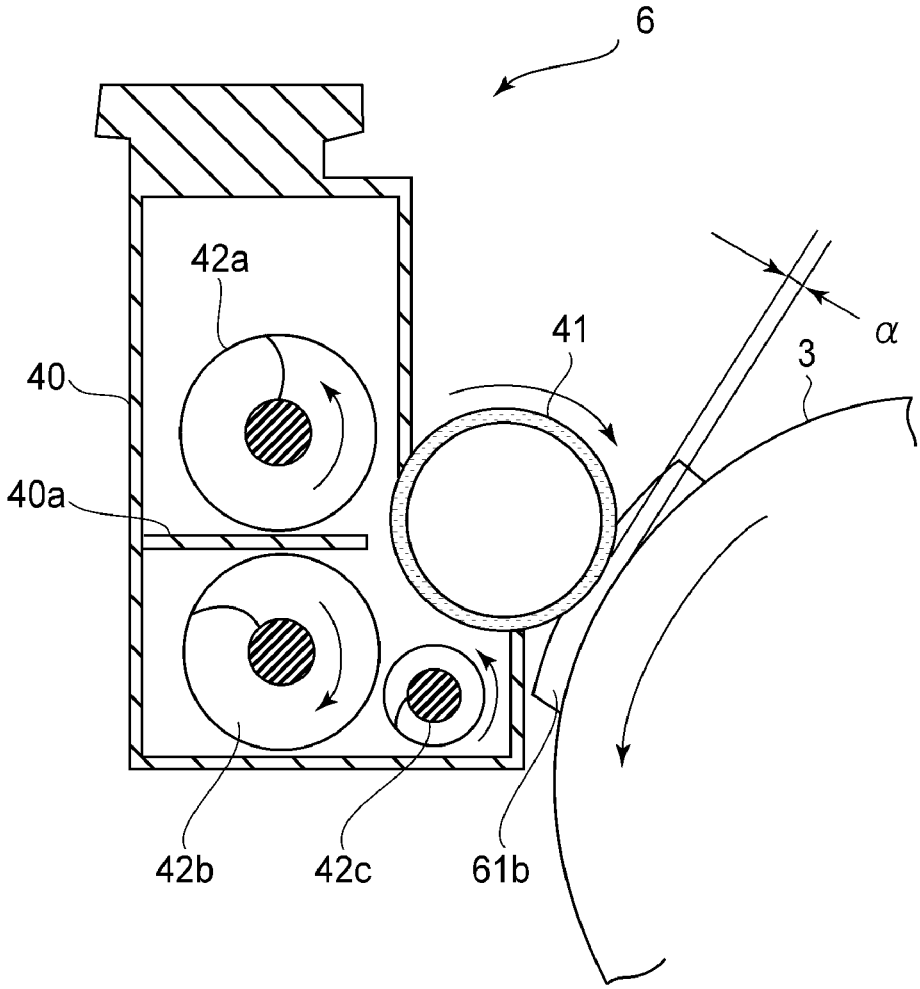
FIG. 5 is a left sectional view of the developing device.
Figure 6:
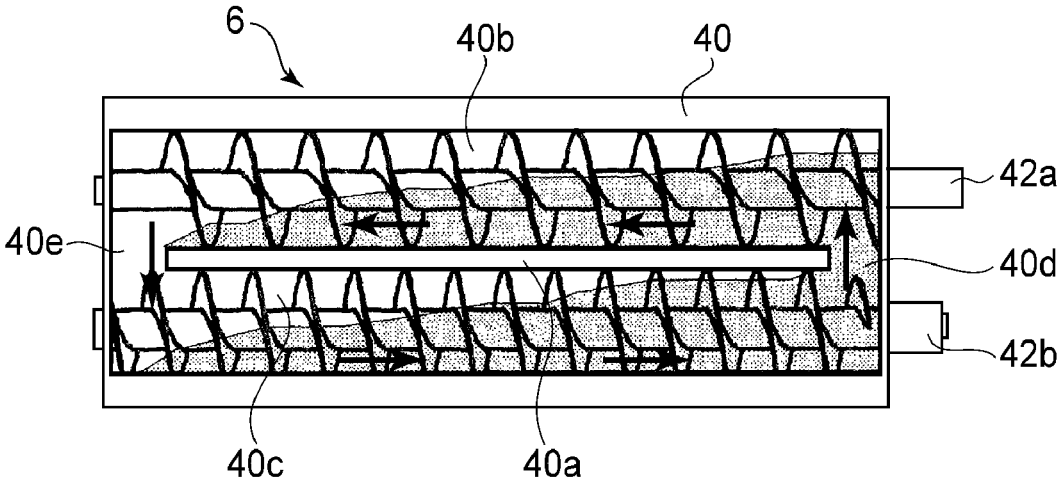
FIG. 6 is a rear view of the developing device.

FIG. 1 and FIG. 2 are a right side view and a left side view of the developing device 6 and the drum 3. FIG. 3 is a perspective view of the developing device 6 and the drum 3. FIG. 4 is a perspective view of the front side of the developing device 6. FIG. 5 is a left sectional view of the developing device 6. FIG. 6 is a rear view of the developing device 6.

The drum 3 is supported rotatably about a supporting shaft 3*a* extended between a left and right frames (unshown) of a main assembly of the image forming apparatus (or process cartridge frame). Left and right flange portions of the drum 3 are supported by the left and right frames, and the left spacer 60*a* and a right-hand spacer 60*b* held by the frames is in contact to the flange portions, respectively. The drum 3 is rotationally driven in the counterclockwise direction of the arrow in FIG. 7 at a predetermined controlled speed by the driving force transmitted through the drum gear (unshown) from a motor (unshown) of the main assembly side of the image forming apparatus. To the left spacer 60*a* and the right-hand spacer 60*b*, abutment members 61*a*, 61*b* are provided on the right and left side of the developing sleeve 41 which is the developer carrying member of developing device (6) abuts. By this, a gap (FIG. 5) between the drum 3 and the developing sleeve 41 is maintained uniformly. The left spacer 60*a* and the right-hand spacer 60*b* are provided at the ends of the drum 3 and contact to abutment members 61*a*, 61*b*, respectively, by the side of the developing sleeve (41) to determine the gap between the drum 3 and the developing sleeve (gap determination member).

The developing device 6 is provided as a horizontally elongated developer container 40 which contains the toner (developer). The front side of the developer container 40 is provided with the developing sleeve 41 as the developer carrying member for carrying the toner and supplying the toner to the drum 3. The left and right end portions of the developing sleeve 41 are supported rotatably by the developer container 40 through bearing portions disposed at the left and right end portions of the developer container 40. The developing sleeve 41 is extended substantially parallel with the rotational axis direction of the drum 3.

An inside of the developer container 40 is provided with a plurality of developer feeding members for carrying out the stirring and feeding operations of the toner in the container. In this embodiment, the first-third feeding screws 42*a*, 42*b*, 42*c* as the developer feeding member are provided. Each of the feeding screws 42*a*, 42*b*, 42*c* are provided with a spiral feeding portion on an outer periphery of a rotation axis, the left and right end portions of the rotation axis are supported rotatably by the developer container 40 through the bearing portions provided on the left and right end portions of the developer container 40. Each of the feeding screws 42*a*, 42*b*, 42*c* are extended in substantially parallel with the rotational axis direction of the developing sleeve 41 more particularly, in they are substantially parallel with the rotational axis direction of the drum 3. In the developing device 6 of the present embodiment, the first and second feeding screws 42*a*, 42*b* are arranged in the vertical direction in the developer container. The first feeding screw 42*a* supplies the toner to the developing sleeve 41, the second feeding screw 42*b* collects and feeds the toner from the developing sleeve 41.

The toner feeding directions of the first and the second feeding screws, 42*a*, 42*b*, inside the developer container are opposite to each other. The first feeding screw 42*a* feeds the toner along the rotation axis toward the rear side (right-hand side) from the front side (left-hand side) in FIG. 5. The second feeding screw 42*b* feeds the toner along the rotation axis toward the front side (left-hand side) from the rear side (right-hand side) in FIG. 5. The toner feeding directions of the second and third feeding screws, 42*b*, 42*c*, are also opposite to each other. The third feeding screw 42*c* feeds the toner along the rotation axis toward the rear side (right-hand side) from the front side (left-hand side) in FIG. 5.

The inside of the developer container is divided by a partition wall 40*a* into a top first chamber (developer chamber) 40*b* and a lower second chamber (stirring chamber) 40*b* with respect the substantially vertical. The first feeding screw 42*a* is placed in a first chamber 40*b*. The second and third feeding screws, 42*b*, 42*c*, are placed in the second chamber 40*c*. The first chamber 40*b* and the second chamber 40*c* communicate with each other in a left opening 40*d* and a right-hand opening 40*e* provided as cutting away portions in the partition wall 40*a* at the ends with respect to a longitudinal direction of the developer container 40, in alignment with the longitudinal direction of the developing sleeve 41. The circulation feeding of the toner in the developer container is carried out between the first chamber 40*b* and the second chamber 40*c* by the first and second feeding screws, 42*a*, 42*b*, as shown by the arrow in FIG. 6. Certain toner is supplied to the developing sleeve 41 in the first chamber 40*b* to develop the electrostatic latent image of the drum 3, and thereafter it collected from the developing sleeve 41 in a second chamber 40*c*. For this reason, as shown by the hatching in FIG. 6, in the first chamber 40*b*, in accordance with the feeding of the toner, the toner is supplied to the developing sleeve 41 by which the toner amount decreases. On the contrary, in the second chamber 40*c*, in accordance with the feeding of the toner, (The in the Figure) the toner collected from the developing sleeve 41 joins by which the toner amount increases, as shown in FIG. 6. In this manner, a toner powder level in the developer container 40 is inclined which is higher toward right-hand in FIG. 6 in the first chamber 40*b* and the second chamber 40*c*.

Here, although omitted in the figures, the right-hand side (left-hand side in FIG. 6) of the developer container 40 is provided with a developer replenishing device, it supplies the toner timely into the second chamber 40*c* through an opening of the toner (unshown) provided above the second chamber 40*c* in the present embodiment.

As shown in FIG. 6, in order to carry out the feeding of the toner from the second chamber 40*c* through the left opening 40*d* to the first chamber 40*b*, it is preferable to maintain the toner powder surface in the left opening 40*d* at a desired height in the second chamber 40*c*. In view of this, it is preferable that the second feeding screw 42*b* always feeds the toner in the longitudinal direction at the rotational speed within a predetermined range, and that the pressure of the toner in the left opening 40*d* of the second chamber 18*b* is high.

A structure for a drive transmission of the developing device 6 will be described. A right-hand end portion of the developing sleeve 41 is provided with a sleeve driving gear 43. By the drive being to the sleeve driving gear 43, the developing sleeve 41 is rotated. This sleeve driving gear 43 is a first driving force receiving member, and it provided at one end portion of the rotational axis direction of the developing sleeve 41, and receives a driving force for driving the developing sleeve 41. The left and right end portions of the developing sleeve 41 are provided with the abutment members 61*a*, 61*b* for abutting to the left spacer 60*a* and the right-hand spacer 60*b* of the drum (3) to keep the constant gap between the drum 3 and the developing sleeve 41. More particularly, the abutment members 61*a*, 61*b* are provided at the ends of the developing sleeve 41, and are abutted to the ends of the drum 3 by which the gap between the drum 3 and the developing sleeve 41 is determined.

A left-hand end portion of the rotation axis of each of the first-third feeding screws 42*a*, 42*b*, 42*c* is provided with a feeding driving gear 44 and idler gears 45*a*, 45*b* for the drive. Each of the gears 44, 45*a*, and 45*b* is a two-stage gear. As for the drive transmission to each of the feeding screws 42*a*, 42*b*, 42*c*, the drive of the motor of the image formation main assembly side is transmitted through a feeding driving input gear 69 to the feeding driving gear 44 provided on the rotation axis of the first feeding screw 42*a*. The drive is transmitted to the idler gears 45*a*, 45*b* from the feeding driving gear 44. More particularly, the first feeding screw 42*a* is rotated by the feeding driving gear 44 being driven. The second feeding screw 42*b* is rotated by the drive being to the idler gear 45*a* from the feeding driving gear 44. The third feeding screw 42*b* is rotated by the drive being to an idler gear 45*b* from the idler gear 45*a*.

The feeding driving gear 44 is a second driving force receiving member, and the driving force for driving the first-third feeding screws 42*a*, 42*b*, 42*c* which is the developer feeding member is transmitted. The sleeve driving gear 43 which is the first driving force receiving member is provided at the one-end portion with respect to the rotational axis direction of the developing sleeve 41, and the feeding driving gear 44 which is the second driving force receiving member is provided at the other end portion with respect to the rotational axis direction of the developing sleeve 41.

A developing device holding member 65 is provided between the right and left frames (unshown) of a main assembly (or process cartridge frame) of the image forming apparatus. This developing device holding member 65 is provided with arm portions 65*a*, 65*b* at the right and left sides. Each of the arm portions 65*a*, 65*b* is provided with the supporting holes 65*c*, 65*d*. The supporting holes 65*c*, 65*d* are engaged with the right and left supporting shafts 71*a*, 71*b* provided on the left and right frames. By this, the developing device holding member 65 is held between the left and right frames swingably about the supporting shafts 71*a*, 71*b*. The left and right supporting shafts 71*a*, 71*b* are co-axial with each other, and substantially parallel to the rotational axis direction of the drum 3. A top side of the developing device 6 is positioned to the developing device holding member 65, and is held by this. A left spring 66*a* and a right-hand spring 66*b* are provided between the left and right frames in the neighborhood which are the longitudinal end portions of the developing device holding member 65, and they are stretched by a spring hooking plate 67. By this, the developing device 6 held by the developing device holding member 65 receives a rotation moment in the direction toward the drum 3 about the supporting shafts 71*a*, 71*b* by a spring force. The left and right abutment members 61*a*, 61*b* of the developing device (6) are pressed to the left and right spacers 60*a*, 60*b* of drum (3) respectively. More particularly, the developing device 6 is supported rotatably by a supporting mechanism (developing device holding members 65, supporting shafts 71*a*, 71*b*) for supporting rotatably relative to the main assembly, and simultaneously it urges to the drum by the left spring 66*a* and the right-hand spring 66*b* as a spring members.

To the sleeve driving gear 43 provided on the developing sleeve 41, the drive driving force is transmitted by a sleeve driving input gear (first drive inputting portion 68 through the gear from the motor of the image formation main assembly side). Similarly, to the feeding driving gear 44, the drive is transmitted by a feeding driving input gear (second drive inputting portion 69 through the gear from the motor of the main assembly of the image forming apparatus).

The relation of the forces applied to the left-hand side and right-hand side of a developing device 4 will be described. First, referring to FIG. 1, a force applied on the left of the developing device 4 will be described. As described above, the developing device 6 is held by the developing device holding member 65 swingable about the supporting shafts 71*a*, 71*b*. In this state, by the left spring 66*a* between the developing device holding member 65 and the spring hooking plate 67, a pulling force Fs applies in the direction indicated by the arrow in FIG. 1 to a spring hooking portion 65*e* of the developing device holding member 65. The developing device holding member 65 receives a rotation moment around the supporting shaft 71*a* by the pulling force Fs. The rotation moment around the supporting shaft 71*a* is similarly applied by the gravity W. By these rotation moments, the force which urges the left abutment member 61*a* of developing device (6) toward the left spacer 60*a* of drum (3) is produced, and the left abutment member 61*a* is pressed to the left spacer 60*a*.

In addition, to the feeding driving gear 44 provided at the left-hand end portion of the first feeding screw 42*a*, the drive of the motor of the main assembly side of the image forming apparatus is transmitted through the feeding driving input gear 69. The arrow shown in FIG. 1 rotates the feeding driving input gear 69 clockwisely, and it rotates the feeding driving gear 44. In this case, the feeding driving gear 44 receives a force in the direction which inclines toward a pressure direction of the gear from a tangential direction of the gear. In the present embodiment, a pressure angle of the gear is the 20 degrees. In other words, the feeding driving gear 44 receives the force Fga in the direction to which it inclines upwardly by the 20 degrees from a tangential direction relative to the feeding driving input gear 69. In the present embodiment, the arrangement is such that the direction of the force Fga is substantially parallel to the direction in which the centers of the developing sleeve 41 and the drum 3 are connected.

By this, to the left abutment member 61*a* a force Fm by the rotation moment and the force Fga by the feeding driving input gear 69 apply and the left abutment member 61*a* is pressed against the spacer 60*a* by the resultant force of them.

Referring to FIG. 2, the force applied on the right side of the developing device 4 will be described. As described above, the developing device 6 is held by the developing device holding member 65 swingable about the supporting shafts 71*a*, 71*b*. In this state by the right-hand spring 66*b* between the developing device holding member 65 and the spring hooking plate 67, the pulling force Fs applies in the direction indicated by the arrow in the Figure to a spring hooking portion 65*f* of the developing device holding member 65. The developing device holding member 65 receives the rotation moment around a supporting shaft 71*b* by this pulling force Fs. The rotation moment around the supporting shaft 71*b* is similarly applied by the gravity W. By these rotation moments, the force which urges a right abutment member 61*b* of developing device (6) toward a right spacer 60*b* of drum (3) side is produced, the right abutment member 61*b* is pressed to the right spacer 60*b*.

In addition, to the sleeve driving gear 43 provided at the right-hand end portion of the developing sleeve 41, the drive of the motor of the main assembly side of the image forming apparatus is transmitted through a sleeve driving input gear 68. The arrow shown in FIG. 2 rotates the sleeve driving input gear 68 clockwisely, and it rotates the sleeve driving gear 43. In this case the sleeve driving gear 43 receives the force in the direction which inclines toward a pressure direction of the gear from the tangential direction of the gear. In the present embodiment, since the pressure angle of the gear is the 20 degrees, the sleeve driving gear 43 receives a force Fgb in the direction to which it inclines downwardly by the 20 degrees from the tangential direction relative to the sleeve driving input gear 68. In the present embodiment, the arrangement is such that the direction of the force Fgb is substantially parallel to the direction in which the centers of the developing sleeve 41 and the photosensitive drum 11 are connected.

By this, to the right abutment member 61*b*, the force Fm by the moment and the force Fgb by the sleeve driving input gear 68 apply and the right abutment member 61*b* is pressed against the right-hand spacer 60*b* by the resultant force of them.

As shown in the present embodiment, at the opposite longitudinal ends of a developing device 40, by the driving force and the spring force in the direction in where the abutment members 61*a*, 61*b* are urged to the spacers 60*a*, 60*b*, the gap between the developing sleeve 41 and the drum 3 can be kept uniform over a whole longitudinal direction.

Conventionally, the driving force is transmitted to the developing device through the gear only from one side. However, with this structure, since the developing device receives the force from the gear, the difference is produced between the pressures between the developing sleeve and the drum at front positions and rear positions, and as a result an image defect such as density unevenness may arise. In the present embodiment, however, since the force is received from the gear at the front and rear positions, the pressure between the developing sleeve and the drum can be stabilized, and the density unevenness can be reduced.

The above described embodiment is summarized as follows.

It is such an image forming apparatus which is provided with the rotatable image bearing member 3 for carrying the latent image and the developing device 6. The developing device 6 supplies the developer to the image bearing member to visualize the latent image by the developer. It provided with the developer container 40 which contains the developer and the rotatable developer carrying member 41 for carrying the developer and for supplying the developer to the image bearing member. The developing device 6 is provided with the rotatable developer feeding member 42 for feeding the developer in the container body of the developer container, and a first driving force receiving member which receives the driving force for driving the developer carrying member 43 and which is provided at the one-end portion with respect to the rotational axis direction of the developer carrying member. The developing device 6 is provided with the second driving force receiving member 44 which is provided at the other end portion of the rotational axis direction of the developer carrying member and which receives the driving force for driving the developer feeding member. The developing device 6 is provided with the abutment members 61*a*, 61*b* which is provided at the opposite ends of the developer carrying member and which determines the gap between the image bearing member and the developer carrying member by abutting to the opposite ends of the image bearing member. The image forming apparatus is provided with the first driving force inputting member 68 which is provided in the main assembly side, and which transmits the driving force directly to the first driving force receiving member 43. The image forming apparatus is provided with the second driving force inputting member 69 which is provided in the main assembly side, and which transmits the driving force directly to the second driving force receiving member 44. The first driving force receiving member and the second driving force receiving member are provided as follows. More particularly, when the driving force is transmitted to the first driving force receiving member 43 and the second driving force receiving member 44, the orientations of the contacting and spacing direction components of the forces applied to the image bearing member from the abutment members are the same.

When the driving force is transmitted to the first driving force receiving member 43 and the second driving force receiving member 44, the developing device receives the forces in the direction of pressing the abutment member toward the image bearing member.

The developing device 6 supplies the developer to the rotatable image bearing member 3 carrying the latent image to visualize the latent image by the developer. The developing device 6 is provided with the developer container 40 which contains the developer, the rotatable developer carrying member 41 for carrying the developer and supplying the developer to the image bearing member, and the rotatable developer feeding member 42 for feeding the developer in the container body of the developer container. The developing device 6 is provided with the first driving force receiving member 43 which is provided at the one-end portion of the rotational axis direction of the developer carrying member and which receives the driving force for driving the developer carrying member. The developing device 6 is provided with the second driving force receiving member 44 which is provided at the other end portion of the rotational axis direction of the developer carrying member and which receives the driving force for driving the developer feeding member. The developing device 6 is provided with the abutment members 61*a*, 61*b* which is provided at the opposite ends of the developer carrying member and which determines the gap between the image bearing member and the developer carrying member by abutting to the opposite ends of the image bearing member. The first driving force receiving member 43 and the second driving force receiving member 44 receive the driving forces directly from the drive outputting members provided in the main assembly side of the image forming apparatus, respectively. At this time, the first driving force receiving member and the second driving force receiving member are provided so that the directions of the contacting and spacing direction components of the forces which the image bearing member receives from the abutment members are the same.

In this way, the drive transmissions for the developing sleeve 41 and the feeding screw 42 are carried out at the respective ends through the paths which are independent from each other. More particularly, the drive transmissions of the developer carrying member 41 and the developer feeding member 42 are carried out individually. By this, the rotational speed of the developer feeding member 42 is maintained at the desired value irrespective of the rotational speed of the developer carrying member 41. In that case, the forces by the gears apply in the direction for stabilizing the pressing of the developing sleeve 41 to the drum 3. More particularly, the forces received from the gears by the developer container 40 by the drive transmissions is substantially parallel to the direction connecting the developer carrying member 41 and the image bearing member 3, and the drive transmissions are carried out at the opposite ends of the developer container 40. By this, the gap between the developer carrying member 41 and the image bearing member 3 is stabilized.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 284222/2008 filed Nov. 5, 2008, which is hereby incorporated by reference.

What is claimed is:

1. An image forming apparatus comprising:

an image bearing member for carrying a latent image;

a developing device including:

i. a rotatable developer carrying member for carrying a developer and for supplying the developer to said image bearing member;

ii. a developer feeding member, provided rotatably in a developing container containing the developer, for feeding the developer;

iii. a first driving force receiving member, provided at one end portion of said developer carrying member with respect to a rotational axis direction of said developer carrying member, for receiving a driving force for driving said developer carrying member;

iv. a second driving force receiving member, provided at the other end portion of said developer carrying member with respect to the rotational axis direction of said developer carrying member, for receiving a driving force for driving said developer feeding member;

v. abutment members provided at respective end portions of said developer carrying member to determine a gap between said image bearing member and said developer carrying member by being abutted to respective end portions of said image bearing member;

a supporting mechanism for supporting said developing device rotatably relative to a main assembly of said apparatus;

a first drive inputting member, provided in said main assembly side of the apparatus, for directly inputting the driving force to said first driving force receiving member; and a second drive inputting member, provided in said main assembly side of the apparatus, for directly inputting the driving force to said second driving force receiving member, wherein said first driving force receiving member and said second driving force receiving member are provided such that directions of components, in directions toward and away from said image bearing member, of forces applied to said abutment members are the same at the time when the driving forces are inputted to said first driving force receiving member and said second driving force receiving member, respectively.

2. An apparatus according to claim 1, wherein when the driving forces are inputted to said first driving force receiving member and said second driving force receiving member, the developing device receives forces in a direction of urging said abutment members toward said image bearing member.

* * * * *